United States Patent [19]

Marion

[11] Patent Number: 4,619,722

[45] Date of Patent: Oct. 28, 1986

[54] PROPELLANT MATERIAL WITH OXIDIZER REDUCTION TO LEAD OXIDE

[75] Inventor: Frank A. Marion, Glendale, Ariz.

[73] Assignee: Universal Propulsion Company, Inc., Phoenix, Ariz.

[21] Appl. No.: 530,956

[22] Filed: Sep. 12, 1983

[51] Int. Cl.[4] ..... C06B 33/14

[52] U.S. Cl. ..... 149/41; 149/19.1; 149/82; 149/43; 149/19.3; 149/83; 149/19.9; 149/87; 102/287; 102/285; 102/291; 102/292

[58] Field of Search ..... 149/19.1, 19.3, 19.6, 149/19.9, 82, 83, 43, 44, 87, 41; 102/283, 285, 291, 292, 287

[56] References Cited

U.S. PATENT DOCUMENTS

| | | | |
|---|---|---|---|
| 3,379,010 | 4/1968 | Harvey | 102/291 X |
| 3,945,202 | 3/1976 | Marion et al. | 149/83 X |
| 4,128,443 | 12/1978 | Pawlak et al. | 149/82 X |

*Primary Examiner*—Peter A. Nelson

*Attorney, Agent, or Firm*—Ellsworth R. Roston; Charles H. Schwartz

[57] ABSTRACT

A solid propellant acts in a chamber to propel a member such as a rocket, the chamber being closed to the atmosphere. The propellant provides high density-impulses and, when combusted, produces end products which do not have any deleterious effects. The propellant preferably includes a binder having hydrocarbon linkages and a lead compound oxidizer formed from an inorganic lead oxidizer salt. This oxidizer has dense characteristics and stable properties at ambient temperatures and through a particular range of temperatures above ambient. The propellant also includes a fuel additive, preferably a metal such as aluminum, having properties of being oxidized by the oxidizer and of reducing the lead. The fuel additive has a percentage by weight relative to the lead compound oxidizer to reduce the lead to lead oxide. The fuel additive is preferably included in the propellant in the range to approximately twenty percent (20%) by weight and is preferably in a fragmentary form. The binder is preferably included in the range of approximately eight percent (8%) to ten percent (10%) by weight. A second oxidizer such as potassium perchlorate may also be included in the propellant. The oxidizers are preferably included in the propellant in the range of approximately seventy-two percent (72%) to ninety-two percent (92%) by weight. An additional binder such as carbon can also be included in the propellant.

35 Claims, 4 Drawing Figures

PROPELLANT MATERIAL WITH OXIDIZER REDUCTION TO LEAD OXIDE

Figure 1:
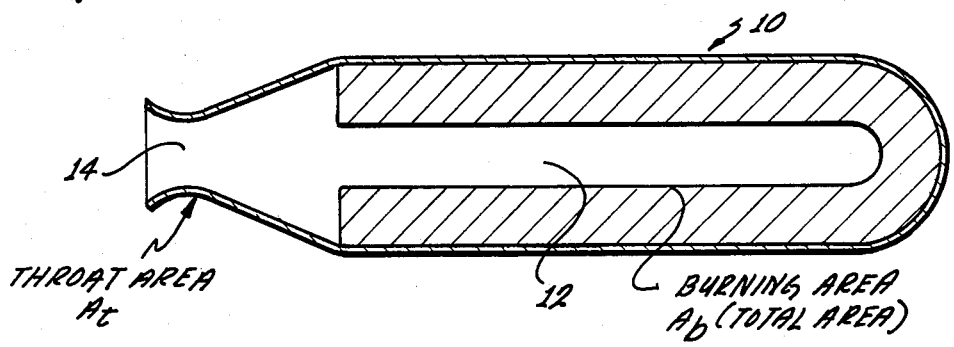

This invention relates to materials for providing an efficient propulsion of vehicles such as rockets. The invention further relates to materials having a high density and stable properties at ambient temperatures and providing considerable energy at elevated temperatures for producing an efficient propulsion of vehicles such as rockets. The invention is particularly concerned with propellants which combust to provide end products which are not deleterious to the propulsion chamber.

For many rocket applications, the amount of propulsion energy capable of being stored in a limited volume of propulsion material is of prime importance. By increasing the amount of energy in each cubic inch of volume of such propulsion material, the volume of propulsion material required to store a particular amount of energy can be accordingly reduced. This in turn allows the rocket to be reduced in size and in weight, thereby causing the drag imposed on the rocket during the flight of the rocket through a fluid such as air or water to be correspondingly reduced. Since the drag imposed on the rocket is reduced, the amount of energy required to propel the rocket through a particular distance is reduced so that the amount of propulsion material required becomes correspondingly reduced. This in turn allows a further reduction in the size of the vehicle, with a corresponding reduction in drag. For the above reasons, a rocket required to push a heavy payload or move through a dense or viscous medium may have an increased efficiency if its propulsion material can be stored in a relatively small volume and can be provided with a high energy level.

The propulsion energy of a material is commonly measured in pound-seconds of force per pound of propellant (lb.sec./lb.). For example, if a propellant has a "specific impulse" of two hundred (200) lb.sec./lb., it can produce in a rocket motor two hundred (200) pounds of thrust (or force), per pound of weight of the propellant, for a duration of one (1) second. It can also produce any combination of thrust and time which, when multiplied, equals two hundred (200) lb.sec.per pound of propellant.

Various attempts have been made to increase the efficiency of propellants. For example, attempts have been made to increase the temperature of combustion of the different materials in the propellant. One broad line of effort has been to use, in the propellant, materials which have a low heat of formation or a low bond energy so that an increased amount of energy is available to be converted into heat. However, in order to have a low heat of formation, the materials generally must have a low margin of stability so that they are more dangerous to process, to store and to use than conventional materials.

Another approach toward increasing the specific impulse of the propulsion material has been to decrease the average molecular weight of the exhaust products. For example, attempts have been made to combust highly energetic materials such as beryllium. However, these metals are quite toxic when vaporized and greatly increase the health hazards of anyone using such metals. Furthermore any use of such metals in a combustible material would tend to add to contaminants in the atmosphere if the metals should become adopted on a widespread basis.

When materials such as magnesium, beryllium and titanium are used in the propulsion material, the density of the propulsion material tends to be reduced since magnesium, titanium and beryllium are relatively light. This has tended to be disadvantageous since the amount of energy obtained in combustion per cubic inch of volume becomes reduced. In other words, even though such metals as beryllium, titanium and magnesium have a high energy, the available energy per cubic inch of the propulsion material has not tended to be increased in view of the decreased density of the material.

When metals such as beryllium have been used in the propulsion material, gases such as hydrogen have been added to the material, generally as a hydride of the metals. These hydrides tend to be somewhat unstable, requiring considerable care and special equipment for safe handling of them.

An extensive list of metallized solid propellants was published in 1966 by Reinhold Publishing Corp. in a book entitled, "Propellant Chemistry". This book was written by Stanley F. Sarner, Senior Research Chemist and Theoretical Analyst of Thiokol Chemical Corporation of Elkton, Maryland. This book lists values of specific impulse and density for approximately twenty (20) formulations of solid propellants which allegedly provide a high energy. The values of specific impulse for these formulations range upwardly to approximately 313.8 lb.sec.per pound of propellant formulation. The values of density are as high as approximately 0.0737 lb./inch$^3$. However, the maximum value of density impulse capable of being provided by any of these formulations is less than approximately 17.9 lb.sec./in$^3$. Furthermore, these formulations involve the use of toxic materials. Actually, practical and operable formulations heretofore available provide maximum values of density impulse of approximately fifteen (15) lb.sec./in$^3$. As will be appreciated, values of density-impulse are important since they indicate the amount of energy available for propulsion per cubic inch of propulsion material.

U.S. Pat. No. 3,945,202 issued to me and Hugh J. McSpadden discloses a propellant which overcomes the disadvantages described above. The propulsion materials disclosed and claimed in U.S. Pat. No. 3,945,202 have a high density and provide a high value of specific impulse. They can be safely and easily formulated and are stable at ambient and elevated temperatures. They are not toxic in their formulation, storage or use. Furthermore, density-impulses as high as approximately twenty-four (24) lb.sec. per pound of formulation have been obtained from the propulsion materials disclosed and claimed in this patent.

The propulsion materials disclosed and claimed in U.S. Pat. No. 3,945,202 include a binder, an oxidizer and a fuel additive. The binder preferably constitutes a hydrocarbon; the oxidizer preferably constitutes an inorganic lead oxidizer; and the fuel additive preferably constitutes particles of a metal such as aluminum. The propellants combust in the combustion chamber to produce end products, one of which may be vaporized lead.

The production of vaporized lead in the combustion chamber is not advantageous. This results from the fact that lead vapor is an effective solvent for steel and for other metals. Lead vapor condenses at a temperature of approximately 1751° C., whereas iron melts at a temperature of approximately 1530° C. Since the combustion chamber will tend to be made from a material such as iron, the walls of the combustion chamber tend to become melted as the lead is vaporized during combustion. Furthermore, the heat of fusion of iron is approximately 3.67 kilocalories per mole and the heat of vaporization of lead is approximately 46.34 kilocalories per mole. As a result, for each mole of lead vapor condensate produced, 12.6 moles of iron can be melted.

Although lead vapor acts as a solvent on steel and other metals, lead oxide does not have such an effect. This results from the fact that lead oxide condenses at a temperature of approximately 1472° C., which is below the melting temperature of iron. Since lead oxide does not have any adverse effects on the walls of the combustion chamber, it is desirable that the end products of the combustion of inorganic lead oxidizer salts should be lead oxide rather than lead.

This invention provides a propellant which preferably a binder having hydrocarbon linkages, an inorganic lead oxidizer salt and a fuel made from a fuel additive such as aluminum. The propellant of this invention combusts to produce as an end product lead oxide rather than lead. The propellant of this invention has a density-impulse which approximates, if not exceeds, the density-impulses of the propellants of U.S. Pat. No. 3,945,202 while providing significantly reduced temperatures during the combustion of the propellant.

The propellant of this invention preferably includes a binder having hydrocarbon linkages and a lead compound oxidizer formed from an inorganic lead oxidizer salt. This oxidizer has dense characteristics and stable properties at ambient temperatures and through a particular range of temperatures above ambient. The propellant also includes a fuel additive, preferably a metal such as aluminum, having properties of being oxidized by the oxidizer and of reducing the lead. The fuel additive has a percentage by weight relative to the lead compound oxidizer to reduce the lead to the lead oxide. The fuel additive is preferably included in the propellant in the range to approximately twenty precent (20%) by weight and is preferably in a fragmentary form. The binder preferably is included in the range of approximately eight percent (8%) to ten percent (10%) by weight. A second oxidizer such as potassium perchlorate may also be included in the propellant. The oxidizers are preferably included in the propellant in the range of approximately seventy-two percent (72%) to ninety-two percent (92%) by weight. An additional binder such as carbon can also be included in the propellant.

Figure 4:
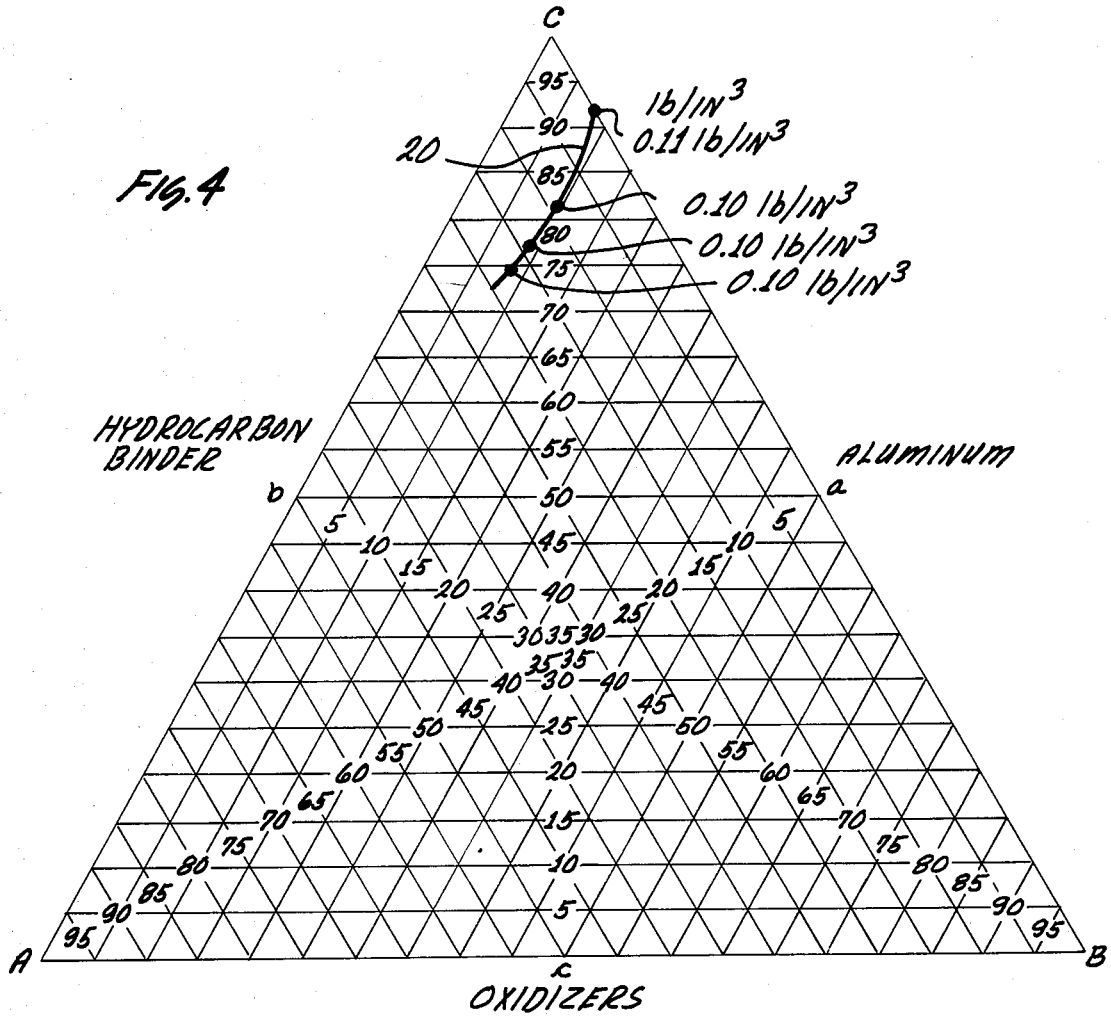
Figure 2:
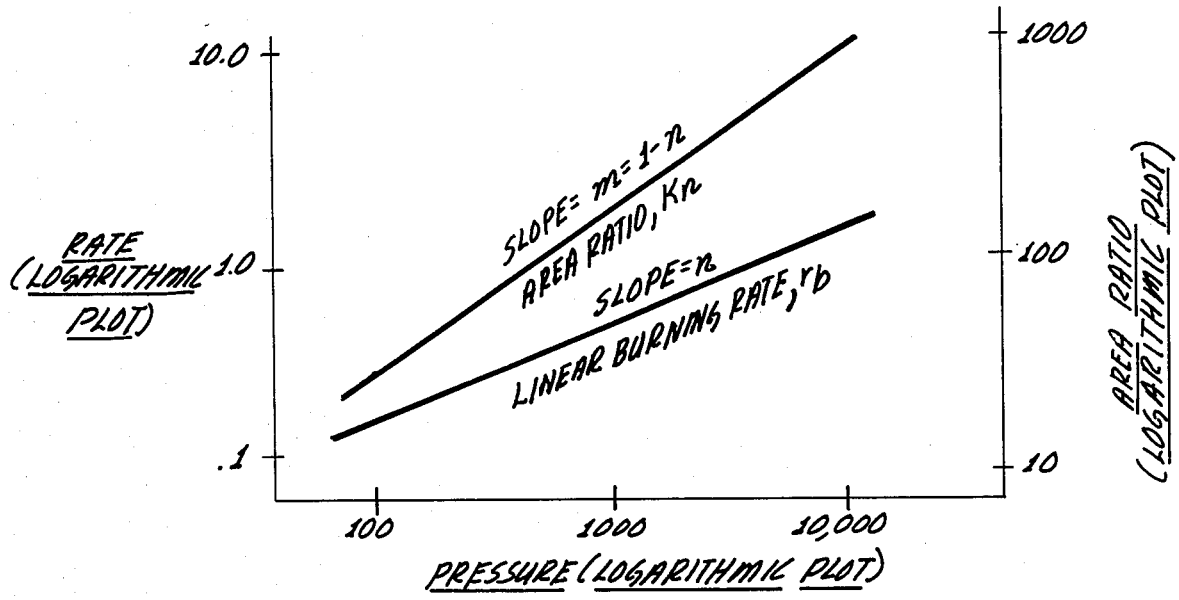
Figure 3:
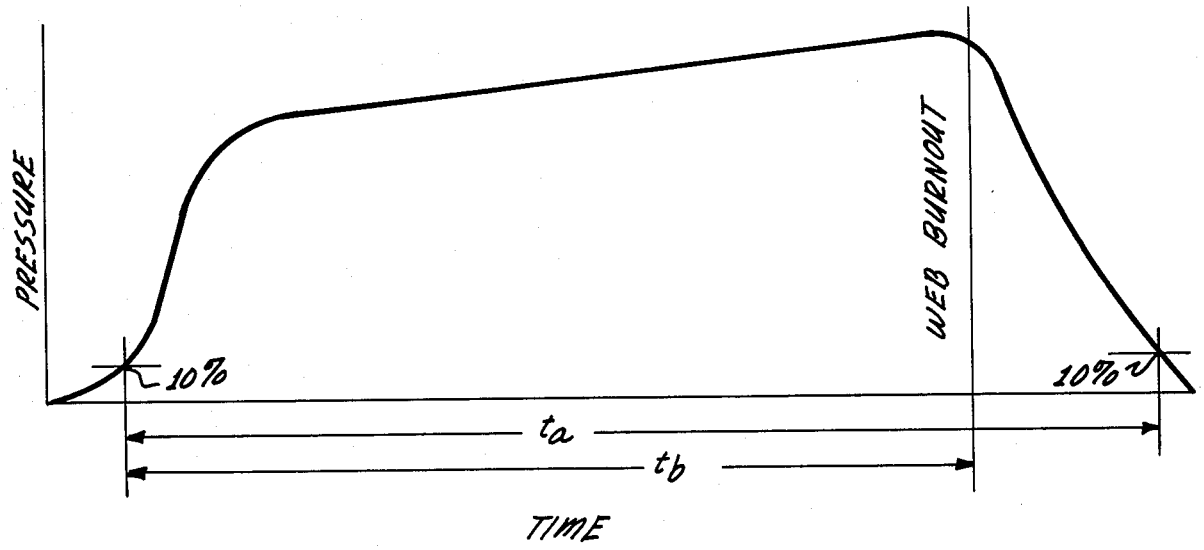

In the drawings:

FIG. 1 illustrates the configuration of a combustion chamber suitable for combusting the propellants of this invention;

FIG. 2 constitutes curves showing the relationship between the pressure of the exhaust gases from the propellant burning in the chamber of FIG. 1 and the rate at which the propellant burns;

FIG. 3 is a curve illustrating the relationship between time and pressure of the exhaust gases from the burning propellant; and FIG. 4 is a curve in triangular coordination of the relative percentages of different chemical components in the propellant of this invention for different formulations of the propellant.

FIG. 1 schematically illustrates a chamber, generally shown at 10, for combusting the propellants of this invention. The walls of the chamber 10 may be made from a suitable material such as iron or steel. The components of the propellant combust in a burning area 12 and escape through a throat area 14. As will be seen, the propellant is isolated from the atmosphere so that the combustion occurs entirely from the components in the propellant.

FIG. 2 illustrates the relationship between the pressure of the gases escaping from the burning area 12 into the throat area 14 and the rate at which the propellant is combusted in the burning area 12. As will be seen, the relationship between rate and pressure is essentially linear with changes in pressure. FIG. 2 also indicates the relationship between pressure of the gases escaping from the burning area 12 into the throat area 14 and the area ratio. As will be seen, this relationship is also essentially linear with changes in pressure.

FIG. 3 illustrates the pressure of the gases at progressive instants of time in the chamber illustrated in FIG. 1. As will be appreciated, the term $t_d$ represents the time between an initial pressure of ten percent (10%) of maximum pressure during the period of pressure build up and ten percent (10%) of maximum pressure during the period of pressure reduction.

The propellants of this invention include a binder preferably having hydrogen and carbon linkages. Preferably the binder includes a material having a formula such as $CH_2$. The binder preferably has properties of being cured at a particular temperature. The binder may also be selected from a group including polysulfides, carboxy-terminated polybutadiene polymers, tetrafluorethylene, polyfluorethylene propylene and acetal homopolymers (which do not cure but remain thermoplastic). These binders are advantageous since they retain good physical properties even in environments at high temperatures. For example, acetal homopolymers designated by the trademark or tradename "Delrin" melt at approximately 354° F. and tetrafluorethylenes designated by the trademark or tradename "Teflon" melt at temperatures above 600° F. Certain of these binders such as the polysulfides and the carboxy-terminated polybutadiene polymers are castable and can be cured at ambient temperatures and also at oven temperatures with other materials to form the propellant formulations constituting the invention. A number of propulsion materials have been formulated successfully with a mixture of a binder such as polybutadiene with carboxy-terminated linkages and a curing agent such as 1, 2, 4 Tris [2-(1-Aziridinyl)Ethyl] Trimellitate. The polybutadiene has been designated as "Butarez CTL Type II". Such a binder constitutes a liquid rubber polybutadiene with carboxy-terminated linkages. It has carboxy end-groups on both ends of the polymer chain, as illustrated as follows:

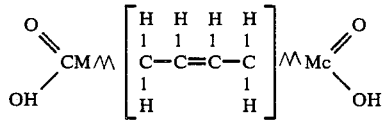

The binder has a relatively narrow molecular weight distribution and is not easily crystallized. This allows the cured composition of the polymer to remain rubbery to very low temperatures.

A lead compound oxidizer, such as an oxidizer formed from an inorganic lead oxidizer salts, is also included in the propellant. The oxidizer preferably constitutes lead nitrate. However, other lead oxidizers such as lead dioxide or lead iodate or any combination of the lead compounds specified above may also be used.

Lead nitrate has approximately 0.041 moles of oxygen per cubic centimeter. It has a specific gravity of approximately 4.53 grams per cubic centimeter. It has a decomposition temperature of approximately 470° C. and has a heat of formation of only approximately 107.35 Kilocalories per mole of oxygen. It can be reacted chemically to produce reasonably good enthalpy.

Lead vaporizes at a temperature of approximately 1751° C. Since this temperature is considerably higher than the melting temperature of iron or steel, the lead melts the iron or steel when it vaporizes and contacts the iron or steel. Since the chamber 10 is generally made from iron or steel, the vapors from the propellant attack the iron or steel when the lead compound oxidizer becomes reduced to lead vapor. It is accordingly desirable to have the lead compound oxidizer become reduced to an end product other than lead. For example, lead oxide condenses at a temperature of approximately 1472° C., which is below the melting temperature of iron. As a result, lead oxide vapor does not act as a solvent on iron or steel.

A fuel additive is also included in the propellant of this invention. The fuel additive is preferably a metal such as aluminum, which becomes oxidized to aluminum oxide by the oxidizer. Preferably the aluminum is in a fragmented form such as in a particulate form. Although such metal is commonly added as a powder, it can be added as filaments of fine wire or as sheets or strips of thin foil. When used, in a fragmentary form such as in filaments or sheets or strips, the aluminum provides substantial physical reinforcement to the propellant. In these forms, the aluminum can provide composites or laminates of high strength. This is desirable since considerable forces must be withstood by a propellant in various applications such as anti-missile rocket applications.

Other metals than aluminum are also theoretically useful as the fuel additive in some propulsion formulations. These include beryllium, magnesium, lithium and titanium. All of these metals are advantageous since they have high melting temperatures. For example, aluminum has a melting temperature of approximately 1220° F. and strontium has a melting temperature of approximately 1202° F. In this way, the propulsion materials can be formulated with reasonable safety when these additives are included. Furthermore, although the melting temperatures of these metals are relatively high, they are still below the melting temperature of steel or iron.

Other materials may be used as secondary oxidizers in association with the inorganic lead compounds. These include strontium nitrate, barium nitrate, cesium nitrate, rubidium nitrate, ammonium perchlorate, potassium permanganate, potassium chlorate, potassium periodate, potassium nitrate, urea nitrate and guanidine nitrate. In addition to serving as oxidizers, these materials have the properties of altering the ballistic and physical properties of the rocket as desired. This secondary oxidizer preferably constitutes potassium perchlorate.

Various additives have been used to control the rate of propellant burning or to change the sensitivity of the burning rate to pressure. These additives have included copper manganite, cupric oxide, iron oxide and a liquid iron containing a burning rate catalyst designated by the trademark or tradename "HYCAT 6". The amount of additive used has varied between zero percent (0%) and five percent (5%) by weight of the propulsion formulation, but in certain formulations the amount of additive has been as high as approximately fifteen percent (15%). Other additives tested have included chromium oxide, manganese dioxide, cuprous oxide, n-butyl ferrocene, cupric acetylacetonate, molybdenal-bis-acetylacetonate, titanium acetylacetonate, calcium oxalate and lead oxalate.

The different materials have been included as follows in the propellant of the prior art:

$$4CH_2+Pb(NO_3)_2+KCl_4+4Al$$

$$2Al_2O_3+4CO+KCl+4H_2+N_2+Pb \qquad (1)$$

The inclusion of the different materials in the relative amounts of equation (1) offers a number of important advantages. For example, the formation of carbon monoxide is desirable because it constitutes approximately −105.6 Kilocalories (−25.4 Kilocalories per mole) of combustion enthalpy. This tends to provide a cooling effect on the combustion gases. Since the carbon is oxidized to carbon monoxide, the carbon cannot absorb heat. This is particularly important since carbon has a high heat capacity.

The propulsion formulation specified above also has other important advantages. For example, although the values of specific impulse for the propellants using the oxidizers specified above range from approximately 190 lb. sec/lb. to approximately 260 lb. sec/lb. and are accordingly within the range of previous propellants, the high density of the propellants using these oxidizers produces theoretical values of density-impulse from approximately 22 lb. sec./in$^3$ to approximately 27.6 lb. sec./in$^3$. Comparing such values with previously available values of approximately 15 lb. sec./in$^3$, this represents an increase of approximately sixty percent (60%) over the density-impulses of previously available propellants.

In spite of the advantages described above, there is one serious disadvantage from the reaction specified in equation (1). This results from the formation of vaporized lead. As previously described, the vaporized lead tends to melt the steel or iron walls of the combustion chamber, thereby limiting the effectiveness of the combustion chamber. The lead vapor is produced by the thermal decomposition of the lead nitrate in the material specified in equation (1).

The materials specified above can be varied in relative amounts to overcome the disadvantage specified in the previous paragraph without losing any of the advantages specified above. For example, the different materials can be included in the relative percentages specified below to provide a combustion which produces lead oxide, rather than lead, in the combustion gases:

$$4CH_2+Pb(NO_3)_2+KClO_4+3\tfrac{1}{2}Al$$

$$1\tfrac{2}{3}Al_2O_3+4CO+KCl+PbO+4H_2+N_2 \qquad (2)$$

The inclusion of the different materials in the percentages specified above in equation (2) offers certain distinct advantages. For example, the formation of lead oxide in the combustion gases inhibits any tendency for the walls of the combustion chamber to melt. This results from the fact that lead oxide vaporizes at a temperature below the melting temperature of steel or iron.

The improved formulation of equation (2) also offers other important advantages. For example, the formulation of equation (2) provides an increased enthalpy over the formulation of equation (1) even though the amount of fuel in the formulation of equation (2) is significantly reduced relative to the amount in the formulation of equation (1). Specifically, the formulation of equation (2) produces an estimated combustion enthalpy of approximately −988 gram-calories/gram versus approximately −931 gram-calories/gram estimated for the formulation of equation (1).

The increased enthalpy for the formulation of equation (2) results in part from the formation of lead oxide. The heat of formation of lead oxide is approximately −52.1 Kilocalories per mole. This is in contrast to an endothermic heat of absorption of approximately 46.34 Kilocalories per mole for the formation of lead. This produces a resultant increase in combustion enthalpy of 52.1+46.34=98.44 Kilocalories per mole for the formulation of equation (2) relative to the formulation of equation (1).

As will be seen, there is a reduction of one third ($\frac{1}{3}$) of a mol of aluminum oxide in the propellant of equation (2) relative to the propellant of equation (1). This represents a reduction in enthalpy, particularly since the reduction of one third ($\frac{1}{3}$) of a mole in the amount of aluminum oxide formed represents a loss in enthalpy such as approximately −133 Kilocalories. However, the net enthalpy per gram is increased by the relative increase in the amount of oxidizer and binder in the propellant of equation (2) relative to the propellant of equation (1). This relative increase results from the reduction of the weight and volume of aluminum in the propellant of equation (2) relative to the propellant of equation (1).

The propellant of equation (2) produces an increase of approximately three percent (3%) in density-impulse relative to the propellant of equation (1). The propellant of equation (2) maintains burning rates and other performance characteristics comparable to the propellant of equation (1). As a result, the propellant of equation (2) can provide a simple replacement for the propellant of equation (1). However, the elimination of lead vapor from the exhaust products of the propellant of equation (2) offers significant improvements in the design of the combustion chamber. This can be accomplished by reductions in the required insulating weight and volume of the combustion chamber, by reduction in the size of special seals and heat sinks and reduction in the heat transfer of vapor condensates at temperatures above the melting point of the material of the chamber walls. As a result, the propellant of equation (2) provides an aggregate improvement in product performance and reliability relative to the propellant of equation (1).

An additional improvement has resulted from a further reduction in the level of aluminum from that of equation (2). This further reduction in aluminum produces a reduction in combustion enthalpy and gas temperatures. This in turn enables the design of members such as rockets with increased burning time without encountering any serious material problems in the construction of rocket chambers and nozzles. The further reduction in the level of aluminum has caused a chemical reaction to be produced as follows:

$$4CH_2+Pb(NO_3)_2+KClO_4+2Al$$

$$Al_2O_3+2CO_2+2CO+4H_2+KCl+N_2+PbO \quad (3)$$

As will be seen, the propellant of equation (3) has the advantage of the propellant of equation (2) because lead oxide, rather than lead, is obtained as one of the combustion products. the decreased amount of the fuel such as aluminum causes the estimated enthalpy to be reduced to an estimated value such as approximately −826 gram-calories/gram from an estimated value of approximately −931 gram-calories/gram for the propellant of equation (1). This constitutes a reduction of approximately eleven and three tenths percent (11.3%) in enthalpy. However, the propellant of equation (3) has an increase of approximately ten percent (10%) in density relative to the propellant of equation (1). This increase is from a value of approximately 0.10 lb/cubic inch to a value of approximately 0.11 lb/cubic inch. This results in an estimated decrease of approximately only one percent (1%) in the density-impulse of the propellant of equation (3) relative to the propellant of equation (1).

The slight reduction in density-impulse in the formulation of equation (3) relative to the formulation of equation (1) is in contrast to the significant reduction in the temperatures of the combustion gases from the propellant of equation (3) relative to the propellant of equation (1). Corresponding reductions occur in the average molecular weight of the exhaust gases. This can in fact increase the specific impulse to produce an over-all improvement in the density-impulse performance of the propellant formulation of equation (3) relative to the propellant formulation of equation (1).

As the level of aluminum is reduced from the formulation of equation (1) toward the formulatin of equation (3), the volume displaced by the reduction in the amount of aluminum can be replaced by an equal volume of high density oxidizer or hydrocarbon binder or by a combination of the two (2). Aluminum has a lower density than the high density oxidizer such as lead nitrate (2.70 vs. 4.53). This causes an increased volume of lead nitrate equal to that in the reduction in the amount of aluminum to produce a sixty-eight percent (68%) increase in specific gravity of lead nitrate relative to aluminum. In other words, replacing aluminum with lead nitrate causes the propellant density to be increased.

Aluminum reduces the burning rate of the propellant of equations (1), (2) and (3). Therefore, as the amount of aluminum in the propellant is reduced, the burning of the propellant is accelerated. This allows some of the potassium perchlorate to be removed from the propellant to maintain a particular burning rate. The potassium perchlorate removed from the propellant can be replaced in volume with a corresponding amount of lead nitrate. Potassium perchlorate has a specific gravity of approximately 2.5298 grams/cubic centimeter whereas lead nitrate has a specific gravity of approximately 4.53 grams/cubic centimeter. The replacement of the potassium perchlorate by lead nitrate accordingly produces an increase in specific gravity of approximately seventy-nine percent (79%) in a given volume.

As the aluminum content of the propellant is reduced below a critical ratio, the combustion enthalpy decreases more rapidly than the increase in density. This causes some reduction in density-impulse to occur. However, the reduction in the temperature of the exhaust gases from the combustion may facilitate design economy and simplicity within an acceptable level of density-impulse performance to warrant the use of such propellants with reduced amounts of aluminum.

Formulations having reduced levels of aluminum are plotted in FIG. 4 in triangular coordinates. In the plots of FIG. 4, the amount of the oxidizer is plotted in the vertical direction, with the apex of the triangle indicating an amount of one hundred percent (100%) and the base of the triangle indicating an amount of zero percent (0%). Similarly, the amount of the hydrocarbon binder is plotted from the left leg of the triangle representing zero percent (0%) as a base and the lower right corner representing one hundred percent (100%). The amount of aluminum is also plotted from the right leg of the triangle representing zero percent (0%) as a base and the lower left corner representing one hundred percent (100%).

As will be seen from FIG. 4, the levels of aluminum can be varied between approximately zero percent (0%) and twenty percent (20%) by weight. The minimal amount of aluminum is preferably at least two percent (2%) by weight for beneficial effects and less than approximately eighteen percent (18%) by weight. This preferred range provides for ease of mixing, processing and casting. The percentage of the hydrocarbon by weight is preferably between approximately eight percent (8%) and ten percent (10%) to provide optimal density-impulse performance for the propellants. This range of weights for the hydrocarbon carbon also facilitates mixing and processing since the binder is a liquid polymer during the mixing and casting processes.

Specific percentages are specified in the table below for the different components in the propellant:

| Hydrocarbon Binder | Lead Nitrate | Potassium Perchlorate | Aluminum | Density Impulse in 16.in$^3$ |
|---|---|---|---|---|
| 8.8 | 52.3 | 21.9 | 17.0 | 0.10 |
| 9.1 | 53.8 | 22.5 | 14.6 | 0.10 |
| 9.7 | 57.1 | 23.9 | 9.3 | 0.10 |
| 8.1 | 71.9 | 2—.0 | 0 | 0.11 |

These different formulations are plotted in the curve illustrated at 20 in FIG. 4.

Specific formulas can be developed at any point selected along the curve illustrated in FIG. 4. Specific performance criteria such as burning rate, specific impulse and density-impulse can be formulated by extrapolating from established data points or by interpolating between established data points. It will be appreciated, however, that the invention is not to be limited to the formulations along the curve of FIG. 4 or the extrapolations or interpolations along the points of such curve.

Carbon can be added to the formulations having reduced levels of aluminum. The carbon acts as a heat transfer mechanism to increase the burning rate of the propellant. Carbon also acts as a physical reinforcing agent in the synthetic rubber matrix. Adding carbon also alters the interior ballistics of the propellant by increasing the mols of gas. This results from an increase in the production of carbon monoxide in the combustion gases. The relatively low heat of formation (approximately −26.4 kilocalories per mol) of carbon monoxide provides an additional cooling effect on the combustion gases.

Combinations of aluminum and carbon as fuel additives expand the spectrum of useful propellant formulations. Specific performance parameters can be modified or tailored to fit an exacting application by ranging the levels of the two (2) additives and by changing their weight ratio.

The formulations constituting this invention provide certain important advantages. One distinct advantage is the production of lead oxide, rather than lead, in the combustion gases. This has resulted from the reduction in the amount of aluminum oxide produced in the combustion gases. This is an unexpected result since aluminum oxide is the highest enthalpy species produced in the combustion gases.

The reduction in the amount of aluminum in the propellant and the production of lead oxide, rather than lead, in the combustion gases has caused some serious thermodynamic, thermochemical and metallurgical problems to be eliminated. It has also enhanced the density-impulse performance of the propellant over a wide range of formulas. The range of formulas is even extended through an additional range of some significance where the density-impulse formulation is not degraded from that obtained from the formulation of equation (1).

Propellant formulations having high density-impulses and containing less than the stoichiometric ratio of aluminum fuel have demonstrated improvements in ballistic performance in rocket motors. The chemically improved exhaust gases of these propellants have caused substantial improvements in their containment to be obtained and have significantly reduced problems of heat transfer and insulation. These problems have been associated with previous propellants and have been based upon stoichiometric levels of aluminum in the formulations.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination for use a propellant,
a binder also constituting a reducing agent,
a first oxidizing material containing lead and oxygen,
a second oxidizing material containing oxygen and a metal other than lead,
a fuel additive comprising a material selected from a group consisting of aluminum, beryllium, magnesium, lithium and titanium,
the first and second oxidizing materials and the fuel additive being provided in relative percentages by weight to obtain a reduction of the first oxidizing material to lead oxide, rather than lead, during the combustion of the propellant.

2. The combination set forth in claim 1 wherein
the fuel additive is included in the combination in a relative percentages to approximately twenty percent (20%) by weight and is in fragmented form.

3. The combination set forth in claim 1 wherein
the first and second oxidizing materials are included in the combination in a relative percentage of approximately seventy-four percent (74%) to ninety-one percent (91%) by weight.

4. The combination set forth in claim 1 wherein
the binder has a relative percentage by weight of approximately eight percent (8%) to ten percent (10%).

5. The combination set forth in claim 2 wherein the first and second oxidizing materials are included in the combination in a relative percentage of approximately seventy-four percent (74%) to ninety-one percent (91%) by weight and the binder is included in the combination in a relative percentage of approximately eight percent (8%) to ten percent (10%) by weight.

6. The combination set forth in claim 2 wherein the first oxidizing material is included in the combination in a relative percentage of approximately fifty-two percent (52%) to seventy-two percent (72%) by weight.

7. The combination set forth in claim 6 wherein the binder is included in the combination in a relative percentage of approximately eight percent (8%) to ten percent (10%) by weight and is provided with hydrogen carbon linkages.

8. The combination set forth in claim 1 wherein carbon is included in the propellant as an additional reducing agent.

9. In combination for use as a propellant,
lead nitrate as an oxidizer,
potassium perchlorate as an oxidizer,
a binder also acting as a reducing agent, and
an amount of aluminum sufficient to obtain the reduction of the lead nitrate to lead oxide, rather than lead, during the combustion of the propellant.

10. The combination set forth in claim 9 wherein the aluminum has a percentage by weight in the combination to approximately twenty percent (20%) by weight.

11. The combination set forth in claim 9 wherein the aluminum has a percentage by weight in the combination of approximately two percent (2%) to eighteen percent (18%).

12. The combination set forth in claim 9 wherein the potassium perchlorate has a percentage by weight in the mixture of approximately twenty percent (20%) to twenty-four percent (24%) and the lead nitrate has a percentage by weight in the mixture of approximately fifty-two percent (52%) to seventy-two percent (72%).

13. The combination set forth in claim 12 wherein the binder has a percentage by weight in the mixture of approximately eight percent (8%) to ten percent (10).

14. The combination set forth in claim, 13, wherein carbon is included as an additional reducing agent.

15. In combination for use as a propellant,
a binder also acting as a reducing agent,
a lead compojnd oxidizer formed from lead oxidizer salts and having dense characteristics and stable properties at ambient temperatures and through a particular range of temperatures above ambient temperatures, and
a fuel additive other than lead disposed in a combustible form and having properties of being oxidized by the oxidizer and of reducing the lead, the fuel additive having a percentage by weight relative to the lead compound oxidizer to reduce the lead compound oxidizer to lead oxide, rather than lead, during the combustion of the propellant.

16. The combination set forth in claim 15 wherein the fuel additive is included in the combination in the range to approximately twenty percent (20%) by weight.

17. The combination set forth in claim 16 wherein the binder included in the combination in the range of approximately eight percent (8%) to ten percent (10%) by weight and is provided with hydrogen and carbon linkages.

18. The combination set forth in claim 16 wherein the lead compound oxidizer is selected from the group consisting of lead nitrate, lead peroxide and lead iodate.

19. The combination set forth in claim 16 wherein carbon is included as an additional reducing agent.

20. In combination for use as a propellent,
a binder also acting as a reducing agent,
a lead compound oxidizer formed from inorganic lead oxidizer salts and having dense characteristics and stable properties at ambient temperatures and through a particular range of temperatures above ambient temperatures, and
a metal fuel additive other than lead disposed in a fragmented form for combustion and having properties of being oxidized by the oxidizer and of reducing the lead,
the metal fuel additive having a percentage by weight in the combination relative to the lead compound oxidizer to reduce the lead compound oxidizer to lead oxide, rather than lead, during the combustion of the propellant.

21. The combination set forth in claim 20, a second inorganic oxidizer containing a metal other 22. The combination set forth in claim 20, carbon serving as an additional reducing.

23. The combination set forth in claim 20 wherein the inorganic lead compound oxidizer is selected from the group consisting of lead nitrate, lead peroxide and lead 24. The combination set forth in claim 20 wherein the metal fuel additive is included in the combination in the range to approximately twenty percent (20%) by weight.

25. The combination set forth in claim 24 wherein the binder is included in the combination in the range of approxim:ately eight percent (8%) to ten percent (10%) by weight and is provided with hydrogen and carbon linkages.

26. The combination set forth in claim 18 wherein the lead compound oxidizer is included in the combination in the range of approximately fifty-two percent (52%) to sevety-two percent (72%) by weight.

27. The combination set forth in claim 1 wherein the fuel additive is aluminum.

28. The combination set forth in claim 9 wherein the aluminum is fragmented.

29. The combination set forth in claim 11 wherein the aluminum is in particulate form.

30. The combination set forth in claim 16 wherein the fuel additive is in particulate form.

31. The combination set forth in claim 15 wherein the fuel additive is in particulate form and consists of a metal selected from a group consisting of aluminum, beryllium, magnesium, titanium and lithium.

32. The combination set forth in claim 25 wherein the lead compound oxidizer is included in the combination in the range of approximately fifty-two percent (52%) to seventy-two percent (72%) by weight.

33. The combination set forth in claim 1 wherein the binder, the first and second oxidizing agents and the additive are provided in relative percentages by weight to obtain the production of carbon monoxide during the combustion of the propellant.

34. The combination set forth in claim 9 wherein the lead nitrate, the potassium perchlorate, the binder and the aluminum have relative percentages by weight to obtain the formation of carbon monoxide during the combustion of the propellant.

35. The combination set forth in claim 15 wherein the binder, the lead compound oxidizer and the fuel additive are provided in relative percentages by weight to obtain the production of carbon monoxide during the combustion of the propellant.

* * * * *